US011359352B2

(12) United States Patent
Fliearman et al.

(10) Patent No.: US 11,359,352 B2
(45) Date of Patent: Jun. 14, 2022

(54) WORK VEHICLE HYDRAULIC SYSTEM WITH FLUID EXCHANGE RESERVOIR

(71) Applicant: Deere & Company, Moline, IL (US)

(72) Inventors: Steven R. Fliearman, Coffeyville, KS (US); Michael J. Cliff, Coffeyville, KS (US)

(73) Assignee: DEERE & COMPANY, Moline, IL (US)

( * ) Notice: Subject to any disclaimer, the term of this patent is extended or adjusted under 35 U.S.C. 154(b) by 42 days.

(21) Appl. No.: 17/003,288

(22) Filed: Aug. 26, 2020

(65) Prior Publication Data

US 2022/0064907 A1 Mar. 3, 2022

(51) Int. Cl.
*E02F 9/22* (2006.01)
*E02F 9/20* (2006.01)

(52) U.S. Cl.
CPC ..... *E02F 9/2292* (2013.01); *E02F 9/202* (2013.01); *E02F 9/207* (2013.01); *E02F 9/2217* (2013.01)

(58) Field of Classification Search
CPC .. F16H 57/0441; F16H 57/0435; E02F 9/202; E02F 9/2292; E02F 9/207
See application file for complete search history.

(56) References Cited

U.S. PATENT DOCUMENTS

| | | | | |
|---|---|---|---|---|
| 4,531,368 | A | 7/1985 | Killen | |
| 4,721,185 | A * | 1/1988 | Weigle | B60R 16/08 123/196 R |
| 10,619,711 | B2 | 4/2020 | Fliearman et al. | |
| 10,647,193 | B2 | 5/2020 | McKinzie et al. | |
| 10,670,124 | B2 | 6/2020 | Rekow et al. | |
| 2011/0135502 | A1 * | 6/2011 | Esch | F04B 23/02 417/53 |

* cited by examiner

*Primary Examiner* — Abiy Teka
(74) *Attorney, Agent, or Firm* — Klintworth & Rozenblat IP LLP

(57) ABSTRACT

A hydraulic system for a work vehicle has a first hydraulic circuit at a first nominal pressure and a second hydraulic circuit at a second nominal pressure different than the first nominal pressure. A dual-chamber hydraulic reservoir includes a first tank associated with the first hydraulic circuit and defining a first opening and a second tank associated with the second hydraulic circuit and defining a second opening. An exchange system has a particulate filter disposed within an exchange path between the first opening of the first tank and the second opening of the second tank. The exchange system is configured to resupply the first tank with hydraulic fluid from the second tank.

15 Claims, 3 Drawing Sheets

WORK VEHICLE HYDRAULIC SYSTEM WITH FLUID EXCHANGE RESERVOIR

STATEMENT OF FEDERALLY SPONSORED RESEARCH OR DEVELOPMENT

Not applicable.

CROSS-REFERENCE TO RELATED APPLICATION(S)

Not applicable.

FIELD OF THE DISCLOSURE

This disclosure relates to hydraulic systems of work vehicles having multiple hydraulic circuits at different hydraulic pressures.

BACKGROUND OF THE DISCLOSURE

Work vehicles, such as those used in the construction, forestry, agriculture and mining industries, often employ hydraulic power to operate work implements, driveline and tractive elements and other operational components of the work vehicles. Hydraulic pumps, motors, accumulators and control valves are used to serve these operating components with the hydraulic power needed to perform the intended tasks. In some cases (e.g., large hydraulic cylinders for positioning a boom), the hydraulic power demands are high, while in other cases (e.g., coolant charge pumps) they are relatively low. The power demands may also vary in the frequency of operation, some components requiring hydraulic power continuously while some components need it only intermittently.

Work vehicles may also employ a charge pump, or transmission pump, to provide transmission clutch control and lubrication or cooling. The charge pump typically runs continuously to provide a low pressure flow of hydraulic fluid at steady state conductions, but may be called upon to provide integer multiples higher pressure to support pressure demands when the transmission is subjected to frequent shifting or forward/reverse direction changes.

SUMMARY OF THE DISCLOSURE

The present disclosure provides a hydraulic system for a work vehicle that improves upon conventional hydraulic systems with multiple hydraulic circuits operating at different pressures.

In one aspect, the present disclosure provides a hydraulic system for a work vehicle that includes a first hydraulic circuit at a first nominal pressure and a second hydraulic circuit at a second nominal pressure different than the first nominal pressure. A dual-chamber hydraulic reservoir includes a first tank associated with the first hydraulic circuit and defining a first opening and a second tank associated with the second hydraulic circuit and defining a second opening. An exchange system has a particulate filter disposed within an exchange path between the first opening of the first tank and the second opening of the second tank. The exchange system is configured to resupply the first tank with hydraulic fluid from the second tank.

In another aspect, the present disclosure provides a hydraulic system for a work vehicle that includes a high pressure hydraulic circuit and a low pressure hydraulic circuit relative to the high pressure hydraulic circuit. A dual-chamber hydraulic reservoir includes a first tank associated with the high pressure hydraulic circuit and defining a first opening and a second tank associated with the low pressure hydraulic circuit and defining a second opening. An exchange system including a particulate filter is disposed within an exchange path between the first opening of the first tank and the second opening of the second tank. The exchange system is configured to resupply the first tank with hydraulic fluid from the second tank.

The details of one or more example embodiments are set-forth in the accompanying drawings and the description below. Other features and advantages will become apparent from the description, the drawings, and the claims.

BRIEF DESCRIPTION OF THE DRAWINGS

At least one example of the present disclosure will hereinafter be described in conjunction with the following figures.

Figure 1:
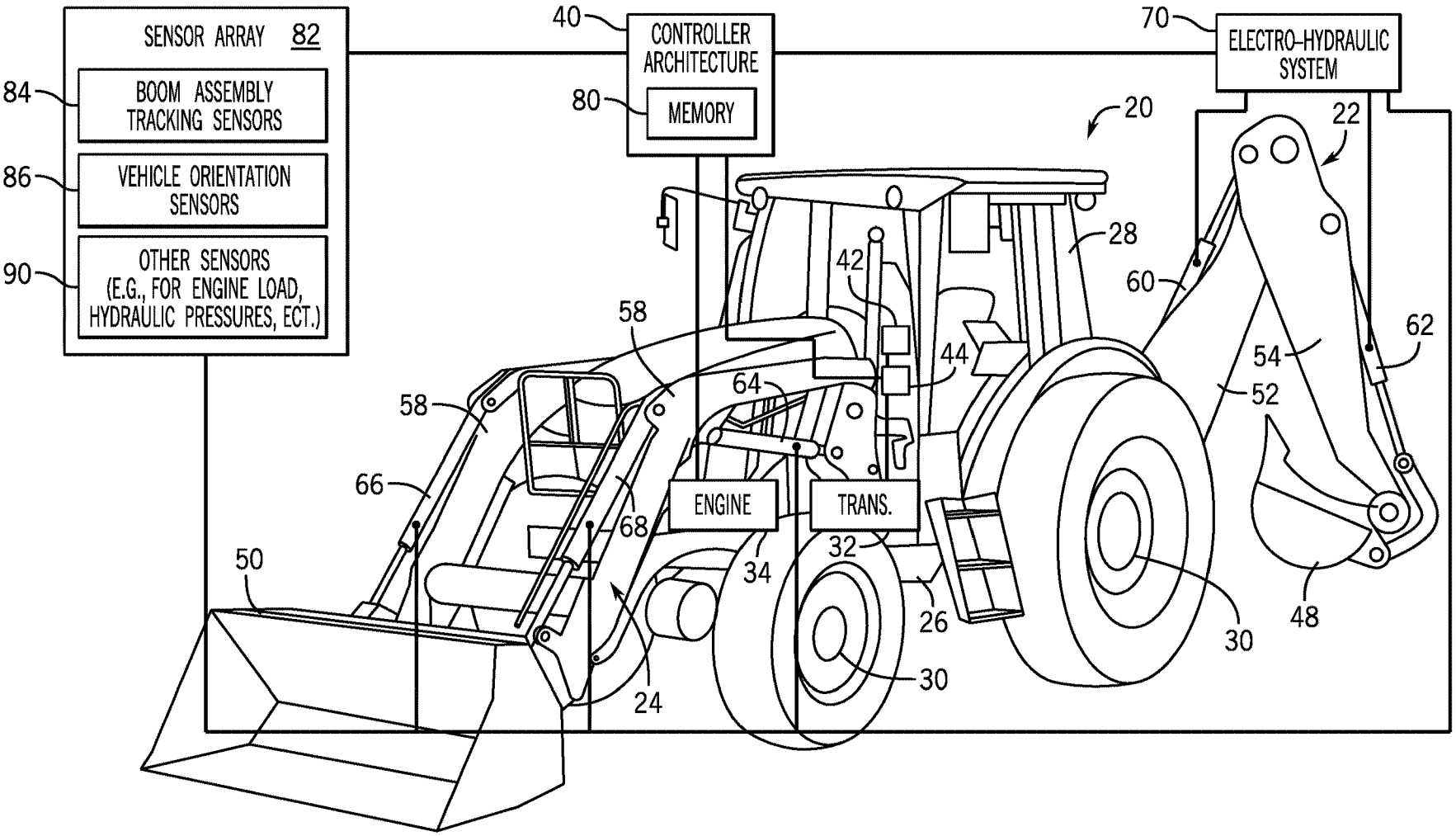
FIG. 1 is an isometric view of an example work vehicle in the form of a backhoe equipped with a hydraulic system in accordance with the present disclosure.

Like reference symbols in the various drawings indicate like elements. For simplicity and clarity of illustration, descriptions and details of well-known features and techniques may be omitted to avoid unnecessarily obscuring the example and non-limiting embodiments of the invention described in the subsequent Detailed Description. It should further be understood that features or elements appearing in the accompanying figures are not necessarily drawn to scale unless otherwise stated.

DETAILED DESCRIPTION

Embodiments of the present disclosure are shown in the accompanying figures of the drawings described briefly above. Various modifications to the example embodiments may be contemplated by one of skill in the art without departing from the scope of the present invention, as set-forth the appended claims.

Overview

Heavy-duty work vehicles commonly employ hydraulic power to operate work implements, driveline and tractive elements, and other operational components. High load carry capacity features, such as loader arms, booms, buckets, forks and so on, typically require high pressure hydraulic circuits and hydraulic cylinders and other actuators to perform various lifting, carrying and digging operations. Other work vehicle components, for example various driveline components, such as transmissions, may operate or include control devices that operate at lower pressures. Typically, these components are part of a separate low, or lower or medium, control pressure hydraulic circuit. Still other operations, such as cooing or lubrication, may operate at or require even lower pressures. The cooling and/or lubrication circuit may be separate or discrete from the other circuits, or in some cases may be combined with the control pressure circuit. In the latter case, a charge pump would typically run continuously at the control pressure needed to support the transmission control system. During steady state operation, the transmission may demand only the low pressure needed for cooling and lubrication, when a higher pressure demand occurs, such as when the transmission is subjected to frequent shifting or forward/reverse direction change, the transmission would require the higher control pressure. In order to serve both functions, the charge pump would need to run at the medium, control pressure continuously, even during times of low demand. This creates inefficiencies in the hydraulic system by unnecessarily demanding energy input to components that do not require it at a given time of operation and which could more effectively be applied to other components of the work vehicle.

Various example implementations of work vehicle hydraulic systems for more efficient operation at multiple hydraulic pressures are described below. The two hydraulic circuits may include a first hydraulic circuit operating at a first nominal pressure and a second hydraulic circuit operating at a second nominal pressure. The first nominal pressure at which the first hydraulic circuit operates may be the high pressure sufficient to operate high-load components of the work vehicle (e.g., lifting, carrying digging, swinging, braking, etc.). The second nominal pressure at which the second hydraulic circuit operates may be low pressure sufficient to provide cooling and lubrication to certain components (e.g., a transmission). The first hydraulic circuit may (e.g., via a pressure regulating arrangement) also serve to provide a control pressure to one or more features, such as the components or devices being cooled and/or lubricated by the second hydraulic circuit. In an example implementation, the control pressure may be a medium pressure sufficient to service both steady state operation and high demand operation of the hydraulic component. It is noted that the pressure values indicated throughout this disclosure are provided as examples and are not intended as limits at which any aspect of the hydraulics system can operate. As compared to a hydraulic system in which a hydraulic component has its control and cooling/lubrication functions provided by the same circuit, the second, or low pressure, hydraulic circuit may be implemented with a pump of lower pressure capability, and thereby cost, such as a low pressure "lube" or coolant pump, since it would only be required to provide the low pressure cooling/lubrication flow, the control pressure being instead provided by the high pressure circuit.

Example implementations of a hydraulic system incorporate a dual-chamber hydraulic reservoir with a limited, highly-filtered fluid exchange for prevention of cross-contamination failures, which can result from normal wear debris, process debris or usage contamination. The dual reservoir system allows two hydraulic circuits to function together with significant reduction of cross contamination risk. In addition, the hydraulic system, or the hydraulic reservoir itself, includes an exchange system that resupplies hydraulic fluid transferred from the one circuit (e.g., the high pressure hydraulic circuit) to another circuit (e.g., the low pressure hydraulic circuit) during operation. Because only the fluid lost during control operations (e.g., solenoid operation of clutch mechanism) has to be returned to the high pressure system, a fine micron low flow filter can be utilized to prevent cross contamination.

Two example implementations of a dual reservoir hydraulic system are described below. It is noted that the examples below are described without limitation. Other example implementations may be provided without departing from the scope of the claims listed below.

In a first example implementation, a static mechanism comprising two coupled tanks with a shared wall provides a flow of hydraulic fluid by gravity through an exchange system having a filter. A first of the two coupled tanks contains hydraulic fluid for a first hydraulic circuit that flows to a high pressure pump operating at a first nominal pressure sufficient to support high pressure hydraulic functions of the work vehicle. The first hydraulic circuit primarily serves a first hydraulic component, which will be understood to describe generally any of one or more hydraulic devices or actuators of the work vehicle. A portion of the hydraulic oil flow may be diverted, scavenged or otherwise directed (e.g., through a flow regulator and accumulator) to a second hydraulic component (e.g., a transmission) to supply hydraulic fluid to one or more control devices (e.g., one or more electric motors, torque transfer devices and the like) at a sufficiently high (medium or control) pressure to operate the transmission at steady state and during high demand shifting and direction changes. The second of the two coupled tanks also stores hydraulic fluid for use by a second hydraulic circuit, which includes a low pressure pump to flow fluid to the transmission (e.g., the control devices) for lubrication and cooling functions. Hydraulic fluid leaked or expressed from the first hydraulic circuit within the transmission during operation of the control devices is returned to the second tank of the reservoir. An equal volume of hydraulic fluid from the second tank is returned to the first tank via the exchange system disposed between the two tanks. The filter ensures debris that may be introduced via the transmission is not passed to the first tank when hydraulic fluid in the first tank is replenished.

In the second example implementation described below, the dual-chamber reservoir may have two tanks that are physically separated and in fluid communication with each other and the exchange system via hydraulic lines. The exchange system may have a pump to pump hydraulic fluid from the second (low pressure) tank to the first (high pressure) tank. The pump may be a low-capacity (i.e., low pressure and flow rate) scavenge pump with low power requirements and operated continuously, or may be a low-capacity transfer pump configured to operate only when triggered by a high-fluid condition in the second (low pressure side) tank of the reservoir or a low-fluid condition in the first (high pressure side) tank of the reservoir.

Thus, the hydraulic system for a work vehicle disclosed herein has a relatively high pressure hydraulic circuit that intersects functionally and physically with a relative low pressure hydraulic circuit to the benefit of allowing pressure from the high pressure circuit to be diverted to perform certain functions that would otherwise require a separate pump or other energy input to the relatively low pressure circuit. In the following examples, the work vehicle is a backhoe loader in which the high pressure hydraulic circuit is used to operate high-load capacity components, such as loader arms and booms, brakes or other such components. Control devices of other components of the vehicle, such as the electric machine and torque transfer devices of the transmission described above, can be operated by hydraulic pressure scavenged from the high pressure hydraulic circuit. Since the high pressure hydraulic circuit is greater than the control pressure demands of the control device, even under high demand operating conditions, the transmission can be operated without a separate, dedicated charge pump, thereby eliminating the associated cost and complexity. Instead, a low pressure and cost pump may be utilized merely to cool the control devices and other transmission components. To make up for the loss of hydraulic fluid from the high pressure circuit during operation of the control devices, this disclosure provides a dual-chamber hydraulic reservoir to transfer a corresponding volume of hydraulic fluid from a low pressure tank to a high pressure tank. This exchange is effected through a fine micron low flow filter to reduce one cross-contamination of the hydraulic circuits, primarily contamination of the high pressure circuit by the low pressure circuit. Various configurations of the dual-chamber hydraulic reservoir have gravity or pump fed exchange systems and shared-wall or physically separated tanks. The hydraulic system may include pressure or other sensors used to detect a clog event of the filter in the exchange system and provide a warning indication to an operator display in the work vehicle and/or to execute a shutdown operation of a hydraulic circuit, the entire hydraulic system or the work vehicle.

Work Vehicle Hydraulic System with Fluid Exchange Reservoir

Referring to FIG. 1, an example work vehicle is shown as a backhoe 20 equipped with a rear excavator assembly 22 and a front end loader (FEL) assembly 24 mounted to and carried by a chassis 26, which also supports an operator cabin 28. The chassis 26 is supported by a number of ground-engaging wheels 30, which are driven through a transmission 32 by a power source both of which are carried by the chassis 26 of the backhoe 20. In one or more implementations, the power source is an internal combustion engine 34, such as a diesel engine, that is controlled by an engine control module (not shown) of control system 40 of the backhoe 20. It should be noted that the use of an internal combustion engine is merely an example, as the power source may be a fuel cell, an electric motor, a hybrid-gas electric motor, or other power-producing devices. The engine 34 selectively drives the wheels 30 to propel the backhoe 20 in a forward or reverse direction. Additionally, the backhoe 20 includes wheel steering components, including various devices (e.g., power steering pumps and lines, steering mechanisms, and the like) that couple manual (e.g., operator steering controls or wheel) and/or automated (via the control system 40) steering input to the wheels, such as the front wheels. In certain examples, the operator cabin 28 a display device 42 and an operator interface 44 (e.g., various control input devices, joysticks and the like) for controlling movement of the excavator assembly 22 and the FEL assembly 24. More specifically, an operator may interact with the operator interface 44 to control movement of the linkage or boom arms of the excavator assembly 22 and the FEL assembly 24 as well as the orientation of an excavator bucket 48 and a loader bucket 50 hinged to the respective assemblies.

During operation, the excavator assembly 22 and the FEL assembly 24 are animated by extension and retraction of hydraulic cylinders 60, 62, 64, 66, 68 included within an electro-hydraulic system 70 of the backhoe 20. These hydraulic cylinders include swing cylinders (not shown), a hoist boom cylinder (not shown), a stick boom cylinder 60, and an excavator bucket cylinder 62 for the excavator assembly 22 and excavator bucket 48 as well as loader arm cylinders 64 (one shown) and loader bucket cylinders 66, 68 for the FEL assembly 24 and loader bucket 50. Extension and retraction of the swing cylinders rotates a hoist boom 52 (and therefore a stick boom 54 and the excavator bucket 48) about a vertical axis relative to the chassis 26. Extension and retraction of the hoist cylinder rotates the hoist boom 52 about a first pivot joint at which the hoist boom 52 is joined to the chassis 26. Extension and retraction of the stick boom cylinder 60 rotates the stick boom 54 about a second pivot joint at which the stick boom 54 is joined to the hoist boom 52. Extension and retraction of the excavator bucket cylinder 62 rotates or "curls" the excavator bucket 48 about a third pivot joint at which the excavator bucket 48 is joined to the stick boom 54. Extension and retraction of the loader arm cylinders 64 rotates a pair of loader arms 58 (and therefore the loader bucket 50) about a horizonal axis relative to the chassis 26. Finally, extension and retraction of the loader bucket cylinders 66, 68 rotates or "curls" the loader bucket 50 about a fourth pivot joint at which the loader bucket 50 is joined to the loader arms 58. Although not shown in FIG. 1 for clarity, the electro-hydraulic system 70 also contains various other hydraulic components, which may include flow lines (e.g., hoses), pumps, a sump, fittings, relief valves, filters, and the like. The electro-hydraulic system 70 may also include various electronic valve actuators and flow control valves, such as spool-type multi-way valves, which can be modulated to regulate the flow of pressurized hydraulic fluid to and from the hydraulic cylinders 60, 62, 64, 66, 68. The flow control valves and possibly the valve actuators may be consolidated into one or more control valve banks.

A controller architecture of the control system 40 controls the operation of electro-hydraulic system 70 and thereby the excavator assembly 22, the FEL assembly 24 and other hydraulic components of the backhoe 20, such as the transmission 32, as detailed further below. The controller architecture can assume any form suitable for performing the control and guidance functions described herein, and thus is utilized in a non-limiting sense to generally refer to the processing architecture of the control system 40. The controller architecture can thus encompass or may be associated with any practical number of processors (central and graphical processing units), individual controllers, computer-readable memories, power supplies, storage devices, interface cards, and other standardized components. For example, in various implementations, the controller architecture may include a combination of multiple controllers, such as one or more implement controllers, electro-hydraulic valve controllers, and/or a vehicle controller that are operably interconnected by a bus or other data-communication connection. The controller architecture may also include or cooperate with any number of firmware and software programs or computer-readable instructions designed to carry-out the various process tasks, calculations, and control/display functions described herein. Such computer-readable instructions may be stored within a non-volatile sector of a memory 80 associated with (accessible to) the controller architecture. While generically illustrated in FIG. 1 as a single block, the memory 80 can encompass any number and type of storage media suitable for storing computer-readable code or instructions, as well as other data utilized to support the operation of the backhoe 20. The memory 80 may be integrated into the controller architecture in embodiments as, for example, a system-in-package, a system-on-a-chip, or another type of microelectronic package or module.

The control system 40 further includes a plurality or array of sensors 82, as schematically represented in the upper left of FIG. 1. The sensor array 82 includes various position tracking sensors 84 for tracking the movement and positioning of the excavator and FEL linkage booms and bucket 48 in three dimensional space, which may include various rotary position sensors, such as a rotary variable displacement transducer (RVDT) or potentiometers, incorporated into the pivot joints and, perhaps, integrated directly into the structure pins for detecting the relative rotational movement. Other sensors can include, for example, linear variable displacement transducers (LVDTs) or other such linear displacement sensors for measuring the stroke of the hydraulic cylinders 60, 62, 64, 66, 68, which can then be converted to angular position values. Additionally, or alternatively, MEMS devices, such as a MEMS accelerometers and gyroscopes packaged as Inertial Measurement Units (IMUs) can be mounted to the chassis 26 or components of the excavator assembly 22 and/or the FEL assembly 24. Such MEMS devices may then communicate with the controller architecture over wired or wireless connections to provide acceleration and/or angular displacement data utilized by the architecture in tracking the movement and position of the buckets 48, 50. In still other embodiments, the tracking sensors 84 may include one or more cameras having fields-of-view encompassing the 3D tool space through which the buckets 48, 50 travel, in which case the controller architecture may track bucket position by visual analysis of the camera feeds. Finally, as further indicated in FIG. 1, the sensor array 82 may also include one or more sensors 86 for monitoring the orientation of the chassis 26, such as MEMS devices, inclinometers, or the like mounted to the chassis 26. In this manner, the controller architecture can consider the orientation of the chassis 26 when tracking the movement of the buckets 48, 50.

The sensor array 82 may also include other types of sensors 90 in addition to sensors for monitoring the orientation of the chassis 26 and the movement of the boom assembly linkages. Such other sensors 90 may include one or more sensors providing data indicative of the forces or pressures encountered within the electro-hydraulic when performing a vehicle operation. In certain cases, such sensors 90 may directly measure or estimate load placed on the transmission 32 or the engine 34. In other instances, such sensors 90 may measure hydraulic fluid pressures within the hydraulic cylinders 60, 62, 64, 66, 68 or hydraulic fluid pressures within the flow circuit network of the electro-hydraulic system 70. The pressure readings received from the pressure sensors 90, or other pressure sensors, may be considered by the controller architecture, such as when carrying-out a contamination protection function, as described more fully below.

As noted above, the backhoe 20 has a transmission 32 that transmits power via rotatory motion from the engine 34 and/or electric motors to the wheels 30. The transmission 32 has gearing that may be controlled to provide a desired mechanical reduction between the engine output and the wheels 30. Generally, to effect the desired gear ratio, the transmission 32 functionally coupled to the electro-hydraulic system 70, which distributes pressurized hydraulic fluid through the transmission 32 to one or more control devices (e.g., clutches, torque converters, etc.) by way of a variety of passages, valves, pumps, filters, and the like. The one or more control devices effect gear shifting among multiple forward gear ratios, multiple reverse gear ratios and forward-reverse directional changes for transmission to the wheels 30. In various implementations, the electro-hydraulic system 70 includes one or more electro-hydraulic control valves, such as a control valve 120 (see FIG. 2), which may be, for example, an electronically controlled modulation valve (ECMV), that controls one or more clutches, such as a clutch 122, which may be hydraulically applied or released, serving as the one or more control devices of the transmission 32. Generally, the control valve 120 senses fluid pressure in the electro-hydraulic system 70 and meters a flow of hydraulic fluid to provide a desired pressure downstream to a hydraulic component with feedback control via the control architecture of the control system 40. Various other types of control valves (e.g., proportional valves, modulated valves, proportional modulated valves, and the like) and/or other types of hydraulic components may be utilized. The control architecture generates commands to control the flow of pressurized hydraulic fluid through the electro-hydraulic system 70 by sending command signals to the various valves and pumps within the transmission 32, including commands to the example electro-hydraulic control valve 120 to engage or disengage the clutch 122 and to maintain a target pressure for actuating the clutch 122. The hydraulic control valve 120 is configured, for example as an electro-hydraulic solenoid valve, to provide a desired control pressure of hydraulic fluid to the clutch 122. The hydraulic control valve 120 monitors pressure in the hydraulic circuit and/or at the clutch 122 and adjust rapidly to maintain optimal clutch performance. One or more pressure sensors, such as sensors 90, may be included within the transmission 32 to inform the control system 40 and aid in control of the transmission 32 by the control architecture.

In certain implementations, the transmission may be configured to operate in various power modes in the forward and/or reverse travel directions, including, for example, mechanical-only power, series-electric power or split-path power modes. In such cases, the transmission 32 may be equipped with one or more electric machines 110 that provide continuously variable power flow and a variator (e.g., planetary gear set arrangement) that serves to combine (or sum) the electrical power with the mechanical power from the engine 34, or to separately route the disparate power modalities through the transmission 32. Example multi-mode transmission configurations are described in U.S. Pat. Nos. 10,647,193; 10,619,711; and 10,670,124, which are hereby incorporated by reference into this document in their entirety as though fully set forth herein. The electric machines 110 in such multi-mode transmission configurations may thus be considered one of the control devices of the transmission 32.

Whether or not the transmission 32 has multiple power mode capabilities, the heat-generating and wear components thereof may be cooled and lubricated by pressurized fluid of the same or a different type (e.g., viscosity, thermal properties, etc.) than that used to control operation of the hydraulic components of the backhoe 20. In some implementations, the lubricating and/or cooling fluid may be part of the electro-hydraulic system 70. In various implementations then, the electro-hydraulic system 70 may serve to lubricate and/or cool various components of the backhoe 20, including the one or more control devices of the transmission 32, which may include various torque transfer components, such as the clutch 122 as well as the electric machine (s) 110 providing multi-mode power transmission.

Additional details of the electro-hydraulic system 70 deployed onboard the backhoe 20 will now be discussed in connection with FIGS. 2-5 in which cross-pressurization of multiple hydraulic circuits operating at different pressures is used advantageously and accommodated for by a dual-chamber reservoir arrangement.

Figure 2:
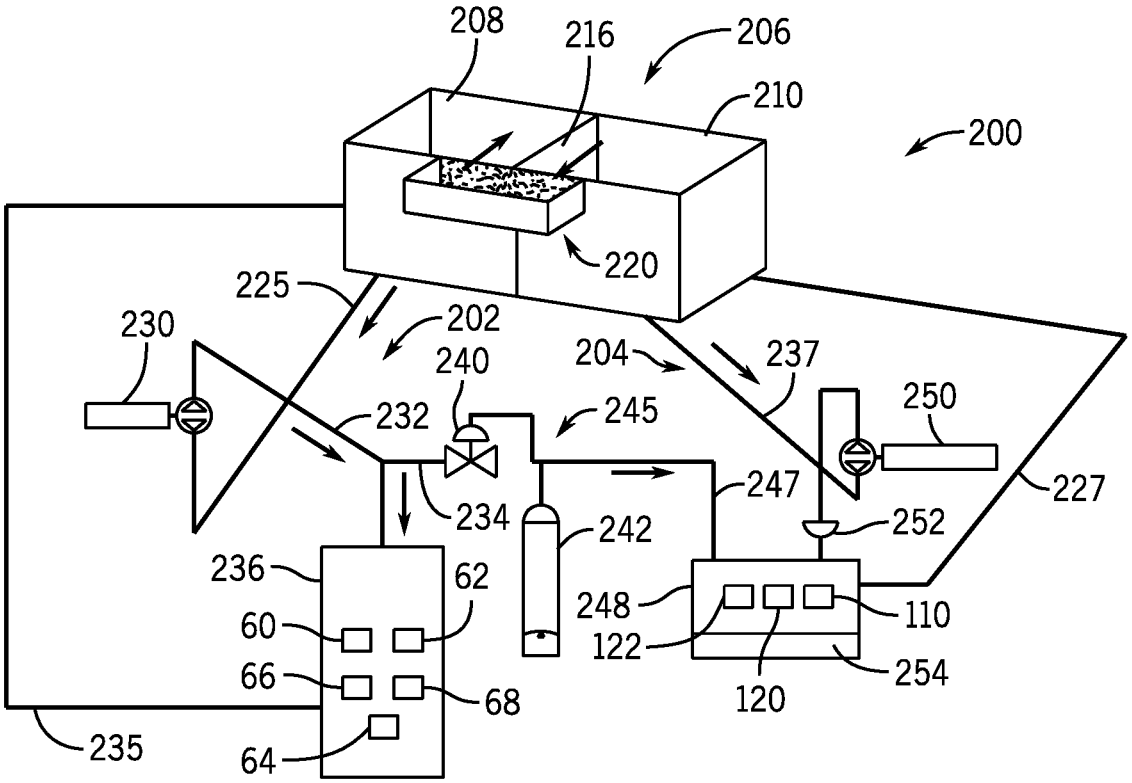
FIG. 2 is a schematic diagram of an example implementation of a hydraulic system in accordance with the present disclosure.
Figure 3:
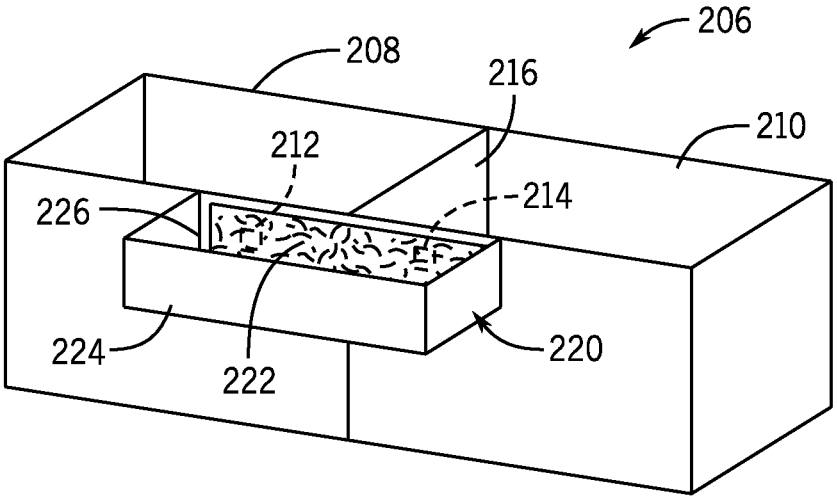
FIG. 3 is a simplified isometric view of an example implementation of a dual-chamber hydraulic reservoir utilized in the example hydraulic system of FIG. 2.

Referring now to FIGS. 2 and 3, a first example implementation of a hydraulic circuit arrangement 200 of the electro-hydraulic system 70 onboard the backhoe 20 is shown having a first hydraulic circuit 202 and a second hydraulic circuit 204. The first hydraulic circuit includes hydraulic components and lines, such as for example, the various boom cylinders, including the stick boom cylinder 60, and the excavator bucket cylinder 62 of the excavator assembly 22 as well as the loader arm cylinders 64 and the loader bucket cylinders 66, 68 of the FEL assembly 24. These components are represented schematically in FIG. 2 as a first hydraulic component 236 since they are operatively coupled to the first hydraulic circuit 202. The hydraulic cylinders 60, 62, 64, 66, 68, as described above, are heavy loading carry capacity components of the backhoe 20 requiring the highest hydraulic pressures during operation. While the work implements and their actuation devices are described as in the example implementations described herein, it should be understood that other high-load components may alternatively or additionally be part of the first hydraulic circuit 202, including, for example, various driveline components, such as various hydraulic drives and hydraulic brakes that control tractive and propulsive operation of the backhoe 20. The first hydraulic circuit 202 includes a first hydraulic pump 230 configured to deliver hydraulic fluid at a first nominal pressure to the first hydraulic component 236. The first hydraulic circuit 202 also has a pressure regulator 240 downstream of the first hydraulic component 236 that is configured to deliver hydraulic fluid at a control pressure to a second hydraulic component 248 of the backhoe 20. The pressure regulator 240 may be implemented using a flow control device regulating a hydraulic accumulator 242 to control pressure of the hydraulic fluid downstream of the first hydraulic component 236 and feeding the second hydraulic component 248. In the example implementations described herein, the second hydraulic component 248 is the transmission 32 having one or more control devices, such as the control valve 120 that controls the clutch 122.

The second hydraulic circuit 204 includes a second hydraulic pump 250 configured to deliver the hydraulic fluid, at a second nominal pressure that is different than the first nominal pressure of the first hydraulic circuit 202, to the second hydraulic component 248. The hydraulic fluid in the second hydraulic circuit 204 serves to provide lubrication and cooling fluid at the second nominal pressure to components of the transmission 32, including the electric machines 110 and the control clutch 122. As with the first hydraulic component 236, other hydraulic components may alternatively or additionally be part of the second hydraulic circuit 204, such that neither the described example implementations, nor the function of the second hydraulic circuit 204 as providing lubrication and coolant, should not be considered limiting of the scope of the disclosed invention. It should also be noted that in the example implementations described herein, the second hydraulic pump 250 may be a low pressure, low capacity, and thereby less costly, pump of any suitable operational configuration, and also that the second hydraulic component 248 may omit a dedicated charge pump, be it either an internal or external charge pump, for operational control of the second hydraulic component 248.

The hydraulic circuit arrangement 200 of the electro-hydraulic system 70 includes a dual-chamber hydraulic reservoir 206 for storing at tank (low or atmospheric) pressure hydraulic fluid used by the hydraulic circuits 202, 204. The example dual-chamber hydraulic reservoir 206 is external or separate from both the first hydraulic component 236 and the second hydraulic component 248 and includes a first tank 208 and a second tank 210. The first hydraulic pump 230 is in fluid communication with the first tank 208 via a high pressure line 225, and the second hydraulic pump 250 is in fluid communication with the second tank 210 via a low pressure line 237. The first tank 208 is configured to supply hydraulic fluid to the first hydraulic circuit 202 aided by suction generated by the first hydraulic pump 230 to flow hydraulic fluid to the first hydraulic component 236 (e.g., hydraulic cylinders 60, 62, 64, 66, 68 to power the excavator assembly 22 and the FEL assembly 24). The first hydraulic pump 230 supplies hydraulic fluid through a high pressure line 232 to the first hydraulic component 236. The first hydraulic circuit 202 has a high pressure return line 235 from the first hydraulic component 236 to return hydraulic fluid to the first tank 208.

Hydraulic fluid flows from the second tank 210 of the hydraulic reservoir 206 to the second hydraulic pump 250 through the low pressure line 237 and to the second hydraulic component 248 for lubrication and cooling. The second hydraulic circuit 204 may also include a cooler 252, for example, in-line with the low pressure line 237 between the second hydraulic pump 250 and the second hydraulic component 248. The second hydraulic component 248 may have a sump 254 to collect hydraulic fluid for lubrication and cooling and coupled to the second tank 210 of the hydraulic reservoir 206 via the low pressure return line 227.

Cross flow and pressurization of hydraulic fluid from the first hydraulic circuit 202 to the second hydraulic circuit 204 is achieved through a cross-feed arrangement 245, which includes the pressure regulator 240 and hydraulic accumulator 242. The pressure regulator 240 is in fluid communication with the first hydraulic pump 230 via the high pressure line 232 and a branch line 234, and thus the cross-feed arrangement 245 may be considered a part of the first hydraulic circuit 202. The pressure regulator 240 is in fluid communication with the hydraulic accumulator 242, and it to the second hydraulic component 248, through one or more control lines 247. The pressure regulator 240 may be actively controlled by the control architecture of the control system 40 and cooperate with the hydraulic accumulator 242 to effect a control pressure within the control line 247 coupling to the one or more control devices (here, the control valve 120 and the clutch 122) within the second hydraulic component 248. The first hydraulic circuit 202 thus serves the cross-feed arrangement 245, and thereby the second hydraulic component 248, and loses a small but consequential volume of hydraulic fluid during operation of the control devices, for example, during operation of the control valve 120 and the clutch 122 as needed to execute a gear ratio change (i.e., a shift event) and/or a direction change. Hydraulic fluid may also be lost or transferred from the first hydraulic circuit 202 to the second hydraulic circuit 204 by leakage of the relatively high pressure fluid at the control pressure to the relatively low pressure environment within the second hydraulic component 248. Such transferred hydraulic fluid may be collected within the sump 254 of the second hydraulic component 248. As such, hydraulic fluid returned via the low pressure return line 227 may include hydraulic oil received by the second hydraulic circuit 204 from the first hydraulic circuit 202. The hydraulic fluid lost or transferred from the first hydraulic circuit 202 to the second hydraulic circuit 204 is returned to the first hydraulic circuit 202 using an exchange system 220 of the hydraulic reservoir 206.

The exchange system 220 includes a particulate filter 222 disposed within an exchange path between a first opening 212 in the first tank 208 and a second opening 214 in the second tank 210. The exchange system 220 resupplies the first tank 208 with a volume of hydraulic fluid in the second tank 210 substantially equivalent to a volume of hydraulic fluid transferred from the control pressure to the second nominal pressure within the second hydraulic component 248. In the FIGS. 2 and 3 example implementation, the hydraulic reservoir 206 has a common or shared wall 216, or alternatively a double-wall, disposed integrally with and between the first tank 208 and the second tank 210. The exchange system 220 includes an exchange housing 224, defining an interior volume 226 which contains the filter 222. The exchange housing 224 spans the wall 216 from the second opening 214 in the second tank 210 to the first opening 212 in the first tank 208. Hydraulic fluid flows from the second opening 214 in the second tank 210 through the flow path of the exchange system 220 and into and through the filter 222 within the exchange housing 224. The filtered hydraulic oil then flows through the first opening 212 and into the first tank 208, thereby replenishing the first hydraulic circuit 202 with a volume of hydraulic fluid lost or transferred to the second hydraulic circuit 204 within the second hydraulic component 248. The hydraulic fluid is passed through the exchange system 220, and the filter 222 thereof, by gravity in the example implementation of FIGS. 2 and 3. As the hydraulic fluid is returned to the second tank 210 and filled to a level rising above the height of the second opening 214; the first tank 208 containing hydraulic fluid at a level less than the height of the first opening 212. The exchange system 220 in this example implementation may thus be considered a gravity-based or passive system since no active control or powered component is required to effect the fluid exchange.

Figure 4:
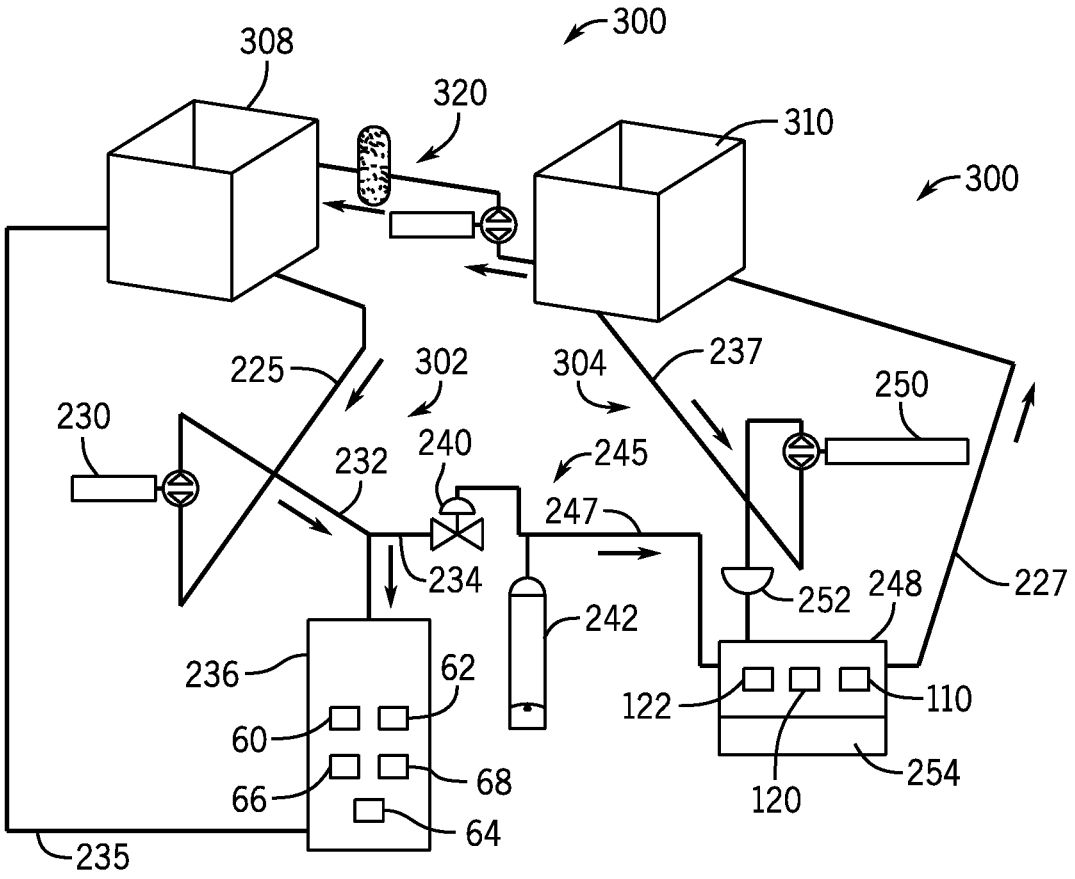
FIG. 4 is a is a schematic diagram of another example implementation of a hydraulic system in accordance with the present disclosure.
Figure 5:
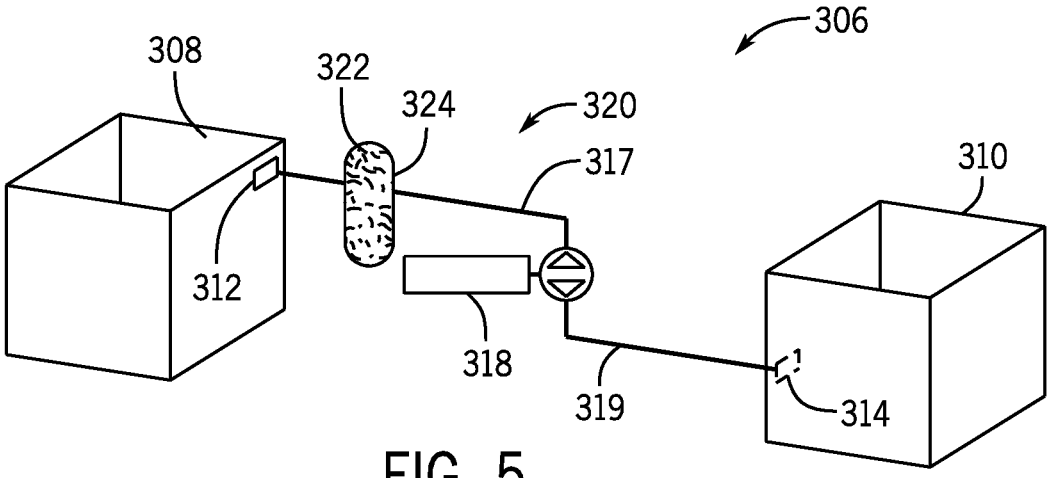
FIG. 5 is a simplified isometric view of another example implementation of a dual-chamber hydraulic reservoir utilized in the example hydraulic system of FIG. 4.

Referring now to FIGS. 4 and 5, another example implementation will be detailed in which the exchange system is powered. In this example implementation, a hydraulic circuit arrangement 300 of the electro-hydraulic system 70 includes a first hydraulic circuit 302 and a second hydraulic circuit 304 that may be identical to the first hydraulic circuit 202 and the second hydraulic circuit 204 described above with regard to example the implementation shown in FIG. 2, and for purposes of clarity, components of each circuit 302, 304 in the FIG. 4 example implementation, are identified using like or identical reference numbers and are not all specifically detailed again herein.

The hydraulic circuit arrangement 300 in the FIG. 4 implementation includes a dual-chamber hydraulic reservoir 306 having a first tank 308 that is physically separate from a second tank 310. The first tank 308 includes a first opening 312 to receive hydraulic fluid during an exchange between the first hydraulic circuit 302 and the second hydraulic circuit 304. The second tank 310 includes a second opening 314, which in essence defines a gravity drain by being located at or near the bottom of the tank. The second opening 314 is coupled to an exchange system 320, which has an exchange housing 324 that is physically separate from both of the tanks 308, 310, with an interior volume containing a particulate filter 322. The exchange housing 324 is coupled to the openings 312, 314 of the tanks 308, 310 by low pressure lines 317, 319. The exchange system 320 also includes an exchange pump 318 in-line with the filter 322 and coupled by the lines 317, 319 to pass hydraulic fluid from the second tank 310 through the filter 322 to the first tank 308. The exchange pump 318 may be any suitable low pressure pump. With low energy consumption, the exchange pump 318 may operate continuously as a scavenge pump, or the exchange pump may operate intermittently as transfer pump either under active control of the control architecture of the control system 40 or actively or passively according to a level of hydraulic fluid within either of the tanks 308, 310.

In the foregoing example implementations, the nominal and control pressures under which the hydraulic circuits operate may depend on the hydraulic components being operated and the pressures required for their operation. Generally, in the described example implementations, the nominal pressure of the first hydraulic circuit is a high pressure, and the second nominal pressure of the second hydraulic circuit is a low pressure relative to the first nominal pressure and the control pressure, which is a medium pressure between the first and second nominal pressures. Besides pressure differences, the flow volume and rate of the hydraulic circuits may vary, again depending largely on the particular hydraulic components involved. In the example implementations discussed herein, the first nominal pressure has the highest flow rate, followed in order by the second nominal pressure and the control pressure. For purposes of disclosing detailed example implementations, in either FIG. 2 or FIG. 4, the first hydraulic pump 230 may operate at a high pressure of about 20 to 35 MPa (i.e., about 3,000 to 5,000 PSI) for the first nominal pressure at a flow rate of about 120 LPM (i.e., about 30 GPM) in the first hydraulic circuit 202; the low pressure pump 250 may operate at a low pressure of about 0.25 to 0.5 MPa (i.e., about 36 to 72 PSI) for the second nominal pressure at a flow rate of about 40 LPM (i.e., about 10 GPM) in the second hydraulic circuit 204; and the charge pressure may be about 1.75 to 2.5 MPa (i.e., about 250 to 300 PSI) at a flow rate of about 2 to 6 LPM (i.e., about 0.5 to 1.5 GPM). In this context, an example of the filter 222, 324 may be a 5 to 20 micron particulate filter permitting a flow of 0.25 to 2 LPM (i.e., about 0.05 to 0.5 GPM), and the hydraulic accumulator 242 may be about 3 to 8 L (i.e., about 0.75 to 2 Gals.).

Thus, the foregoing examples may be implemented in the electro-hydraulic system 70 to allow cross-pressurization from the higher pressure first hydraulic circuit 202, 302 to the lower pressure second hydraulic circuit 204, 304 in order to operate hydraulic components that would otherwise require a separate, dedicated hydraulic pump. The fluid exchange systems 220, 320 of the hydraulic reservoirs 206, 306 ensure that hydraulic fluid lost or transferred from the high pressure circuit is returned in like volume. Cross-contamination between the hydraulic circuits is reduced or eliminated by the filtering of the exchange systems 220, 320. To prevent or detect filter clogging, one or more sensors, such as pressure sensors 90 located in the exchange system 220, 320 or elsewhere in either of the hydraulic circuits, may be utilized to inform the control system 40 of an improper pressure condition, which may trigger the control architecture to do one or more of: send a notification signal to the operator display device 42; terminate or reduce the demands on or output of the electro-hydraulic system 70 (e.g., terminate or derate pump operation); terminate or hamper operation of the work implements or other primary users of hydraulic power, or terminate or derate the power system of the backhoe 20 itself.

Enumerated Examples of Work Vehicle Hydraulic System

Also, the following examples are provided, which are numbered for ease of reference.

1. A hydraulic system for a work vehicle including: a first hydraulic circuit at a first nominal pressure; a second hydraulic circuit at a second nominal pressure different than the first nominal pressure; a dual-chamber hydraulic reservoir including a first tank associated with the first hydraulic circuit and defining a first opening and a second tank associated with the second hydraulic circuit and defining a second opening; and an exchange system including a particulate filter disposed within an exchange path between the first opening of the first tank and the second opening of the second tank; wherein the exchange system is configured to resupply the first tank with hydraulic fluid from the second tank.

2. The hydraulic system of example 1, wherein the second hydraulic circuit includes a second hydraulic component including one or more hydraulic control devices; wherein a volume of hydraulic fluid from the first hydraulic circuit is transferred to the second hydraulic circuit within the second hydraulic component during operation of the one or more hydraulic control devices or steady state operation of the second hydraulic component; and wherein the exchange system is configured to resupply the first tank with the volume of hydraulic fluid from the second tank.

3. The hydraulic system of example 2, wherein the exchange system uses gravity to transfer hydraulic fluid from the second tank through the particulate filter to the first tank.

4. The hydraulic system of example 3, wherein the reservoir includes an exchange housing spanning the first opening of the first tank and the second opening of the second tank and defining an interior volume containing the particulate filter and in fluid communication with the first opening of the first tank and the second opening of the second tank, whereby gravity forces hydraulic fluid from within the second tank through the second opening into the interior volume of the exchange housing, through the particulate filter and through the first opening into the first tank.

5. The hydraulic system of example 4, wherein the first tank and the second tank are joined together along a shared wall disposed between the first opening of the first tank and the second opening of the second tank and spanned by the exchange housing.

6. The hydraulic system of example 2, wherein the first tank and second tank are physically separate structures and the second opening of the second tank defines a gravity drain; wherein the gravity drain is coupled to the exchange housing containing the particulate filter and the exchange housing is coupled to the first opening of the first tank by conduits; wherein the exchange system includes an exchange pump to pass hydraulic fluid from the second tank through the conduits and the particulate filter to the first tank; and wherein the exchange pump is a continuously operating scavenge pump or an intermittently operating transfer pump configured to operate according to a level of hydraulic fluid within the first or second tank.

7. The hydraulic system of example 2, wherein the first hydraulic circuit includes a first hydraulic pump in fluid communication with the first tank and configured to deliver hydraulic fluid at the first nominal pressure to a first hydraulic component of the work vehicle; a pressure regulator downstream of the first hydraulic component and configured to deliver hydraulic fluid at a control pressure to the one or more control devices of the second hydraulic component; wherein the pressure regulator includes a flow control device regulating a hydraulic accumulator to deliver hydraulic fluid at the control pressure to the one or more control devices of the second hydraulic component; wherein the second hydraulic circuit includes a second hydraulic pump in fluid communication with the second tank and configured to deliver hydraulic fluid at the second nominal pressure to the one or more control devices of the second hydraulic component; and wherein the first hydraulic circuit includes a first return line from the first hydraulic component to the first tank and the second hydraulic circuit includes a second return line from the second hydraulic component to the second tank.

8. The hydraulic system of example 7, wherein the first nominal pressure is a high pressure, the second nominal pressure is a low pressure relative to the first nominal pressure, and the control pressure is a middle pressure between the first nominal pressure and the second nominal pressure; and wherein the one or more control devices of the second hydraulic component receive a higher flow rate of hydraulic fluid at the second nominal pressure than at the control pressure.

9. The hydraulic system of example 8, wherein the second hydraulic component is a transmission and the one or more control devices include a torque transfer component; wherein the first hydraulic circuit delivers hydraulic fluid at the control pressure to effect control of the torque transfer component; and wherein the exchange system resupplies the first tank with hydraulic fluid from the second tank substantially equivalent to the volume of hydraulic fluid transferred from the control pressure to the second nominal pressure at the torque transfer component.

10. The hydraulic system of example 9, wherein the second hydraulic component includes an electric machine; wherein the second hydraulic circuit delivers hydraulic fluid at the second nominal pressure to effect one or more of cooling and lubrication of the electric machine and the torque transfer component; and wherein the first hydraulic component includes one or more hydraulic cylinders.

11. A hydraulic system for a work vehicle including: a high pressure hydraulic circuit; a low pressure hydraulic circuit relative to the high pressure hydraulic circuit; a dual-chamber hydraulic reservoir including a first tank associated with the high pressure hydraulic circuit and defining a first opening and a second tank associated with the low pressure hydraulic circuit and defining a second opening; and an exchange system including a particulate filter disposed within an exchange path between the first opening of the first tank and the second opening of the second tank; wherein the exchange system is configured to resupply the first tank with hydraulic fluid from the second tank.

12. The hydraulic system of example 11, wherein the first hydraulic circuit includes a first hydraulic pump in fluid communication with the first tank and configured to deliver hydraulic fluid at the first nominal pressure to a first hydraulic component of the work vehicle; and wherein the second hydraulic circuit includes a second hydraulic pump in fluid communication with the second tank and configured to deliver hydraulic fluid at the second nominal pressure to one or more control devices of the second hydraulic component.

13. The hydraulic system of example 12, wherein the first nominal pressure is a high pressure, the second nominal pressure is a low pressure relative to the first nominal pressure, and the control pressure is a middle pressure between the first nominal pressure and the second nominal pressure.

14. The hydraulic system of example 13, wherein the second hydraulic component is a transmission and the one or more control devices include a torque transfer component; wherein the first hydraulic circuit delivers hydraulic fluid at the control pressure to effect control of the torque transfer component during which a volume of hydraulic fluid from the first hydraulic circuit is transferred to the second hydraulic circuit; and wherein the exchange system resupplies the first tank with hydraulic fluid from the second tank substantially equivalent to the volume of hydraulic fluid transferred from the first hydraulic circuit to the second hydraulic circuit within the second hydraulic component.

15. The hydraulic system of example 14, wherein the second hydraulic component includes an electric machine; and wherein the second hydraulic circuit delivers hydraulic fluid at the second nominal pressure to effect one or more of cooling and lubrication of the electric machine and the torque transfer component.

CONCLUSION

There has thus been described example embodiments of hydraulic system for a work vehicle in which a relatively high pressure hydraulic circuit intersects functionally and physically with a relative low pressure hydraulic circuit to the benefit of allowing pressure from the high pressure circuit to be diverted to perform certain functions that would otherwise require a separate pump or other energy input to the relatively low pressure circuit. In the foregoing examples, the work vehicle is a backhoe loader in which the high pressure hydraulic circuit is used to operate high-load capacity components, such as loader arms and booms, brakes or other such components. Control devices of other components of the vehicle, such as the electric machine and torque transfer devices of the transmission described above, can be operated by hydraulic pressure scavenged from the high pressure hydraulic circuit. Since the high pressure hydraulic circuit is greater than the control pressure demands of the control device, even under high demand operating conditions, the transmission can be operated without a separate, dedicated charge pump, thereby eliminating the associated cost and complexity. Instead, a low pressure and cost pump may be utilized merely to cool the control devices and other transmission components. To make up for the loss of hydraulic fluid from the high pressure circuit during operation of the control devices, this disclosure provides a dual-chamber hydraulic reservoir to transfer a corresponding volume of hydraulic fluid from a low pressure tank to a high pressure tank. This exchange is effected through a fine micron low flow filter to reduce one cross-contamination of the hydraulic circuits, primarily contamination of the high pressure circuit by the low pressure circuit. Various configurations of the dual-chamber hydraulic reservoir have been described including gravity and pump fed exchange systems and reservoirs with shared-wall or physically separated tanks. Pressure or other sensors may be used to detect a clog event of the filter in the exchange system and provide a warning indication to an operator display in the work vehicle and/or to execute a derate or shutdown operation of a hydraulic circuit, the entire hydraulic system or other components of the work vehicle.

As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A hydraulic system for a work vehicle comprising:

a first hydraulic circuit at a first nominal pressure;

a second hydraulic circuit at a second nominal pressure different than the first nominal pressure and including a second hydraulic component including one or more hydraulic control devices;

a dual-chamber hydraulic reservoir including a first tank associated with the first hydraulic circuit and defining a first opening and a second tank associated with the second hydraulic circuit and defining a second opening; and an exchange system including a particulate filter disposed within an exchange path between the first opening of the first tank and the second opening of the second tank, wherein the exchange system uses gravity to transfer hydraulic fluid from the second tank through the particulate filter to the first tank;

wherein a volume of hydraulic fluid from the first hydraulic circuit is transferred to the second hydraulic circuit within the second hydraulic component during operation of the one or more hydraulic control devices or steady state operation of the second hydraulic component; and wherein the reservoir includes an exchange housing spanning the first opening of the first tank and the second opening of the second tank and defining an interior volume containing the particulate filter and in fluid communication with the first opening of the first tank and the second opening of the second tank, whereby gravity forces hydraulic fluid from within the second tank through the second opening into the interior volume of the exchange housing, through the particulate filter and through the first opening into the first tank.

2. The hydraulic system of claim 1, wherein the first tank and the second tank are joined together along a shared wall disposed between the first opening of the first tank and the second opening of the second tank and spanned by the exchange housing.

3. The hydraulic system of claim 1, wherein the first tank and second tank are physically separate structures and the second opening of the second tank defines a gravity drain;

wherein the gravity drain is coupled to the exchange housing containing the particulate filter and the exchange housing is coupled to the first opening of the first tank by conduits; and wherein the exchange system includes an exchange pump to pass hydraulic fluid from the second tank through the conduits and the particulate filter to the first tank.

4. The hydraulic system of claim 3, wherein the exchange pump is a continuously operating scavenge pump or an intermittently operating transfer pump configured to operate according to a level of hydraulic fluid within the first or second tank.

5. A hydraulic system for a work vehicle comprising:

a first hydraulic circuit at a first nominal pressure;

a second hydraulic circuit at a second nominal pressure different than the first nominal pressure and including a second hydraulic component including one or more hydraulic control devices;

a dual-chamber hydraulic reservoir including a first tank associated with the first hydraulic circuit and defining a first opening and a second tank associated with the second hydraulic circuit and defining a second opening; and an exchange system including a particulate filter disposed within an exchange path between the first opening of the first tank and the second opening of the second tank;

wherein a volume of hydraulic fluid from the first hydraulic circuit is transferred to the second hydraulic circuit within the second hydraulic component during operation of the one or more hydraulic control devices or steady state operation of the second hydraulic component;

wherein the exchange system is configured to resupply the first tank with the volume of hydraulic fluid from the second tank; and wherein the first hydraulic circuit includes:

a first hydraulic pump in fluid communication with the first tank and configured to deliver hydraulic fluid at the first nominal pressure to a first hydraulic component of the work vehicle; and a pressure regulator downstream of the first hydraulic component and configured to deliver hydraulic fluid at a control pressure to the one or more control devices of the second hydraulic component.

6. The hydraulic system of claim 5, wherein the pressure regulator includes a flow control device regulating a hydraulic accumulator to deliver hydraulic fluid at the control pressure to the one or more control devices of the second hydraulic component.

7. The hydraulic system of claim 6, wherein the second hydraulic circuit includes a second hydraulic pump in fluid communication with the second tank and configured to deliver hydraulic fluid at the second nominal pressure to the one or more control devices of the second hydraulic component.

8. The hydraulic system of claim 7, wherein the first hydraulic circuit includes a first return line from the first hydraulic component to the first tank and the second hydraulic circuit includes a second return line from the second hydraulic component to the second tank.

9. The hydraulic system of claim 8, wherein the first nominal pressure is a high pressure, the second nominal pressure is a low pressure relative to the first nominal pressure, and the control pressure is a middle pressure between the first nominal pressure and the second nominal pressure; and wherein the one or more control devices of the second hydraulic component receive a higher flow rate of hydraulic fluid at the second nominal pressure than at the control pressure.

10. The hydraulic system of claim 8, wherein the second hydraulic component is a transmission and the one or more control devices include a torque transfer component;

wherein the first hydraulic circuit delivers hydraulic fluid at the control pressure to effect control of the torque transfer component; and wherein the exchange system resupplies the first tank with hydraulic fluid from the second tank substantially equivalent to the volume of hydraulic fluid transferred from the control pressure to the second nominal pressure at the torque transfer component.

11. The hydraulic system of claim 10, wherein the second hydraulic component includes an electric machine; and wherein the second hydraulic circuit delivers hydraulic fluid at the second nominal pressure to effect one or more of cooling and lubrication of the electric machine and the torque transfer component.

12. The hydraulic system of claim 11, wherein the first hydraulic component includes one or more hydraulic cylinders.

13. A hydraulic system for a work vehicle comprising:

a high pressure hydraulic circuit;

a low pressure hydraulic circuit relative to the high pressure hydraulic circuit;

a dual-chamber hydraulic reservoir including a first tank associated with the high pressure hydraulic circuit and defining a first opening and a second tank associated with the low pressure hydraulic circuit and defining a second opening; and an exchange system including a particulate filter disposed within an exchange path between the first opening of the first tank and the second opening of the second tank;

wherein the exchange system is configured to resupply the first tank with hydraulic fluid from the second tank;

wherein the high pressure hydraulic circuit includes a first hydraulic pump in fluid communication with the first tank and configured to deliver hydraulic fluid to a first hydraulic component of the work vehicle;

wherein the low pressure hydraulic circuit includes a second hydraulic pump in fluid communication with the second tank and configured to deliver hydraulic fluid to one or more control devices of a second hydraulic component; and wherein the high pressure hydraulic circuit includes a pressure regulator downstream of the first hydraulic component and configured to deliver hydraulic fluid at a control pressure to the one or more control devices of the second hydraulic component, the control pressure is a middle pressure between a high pressure of the high pressure hydraulic circuit and a low pressure of the low pressure hydraulic circuit.

14. The hydraulic system of claim 13, wherein the second hydraulic component is a transmission and the one or more control devices include a torque transfer component;

wherein the high pressure hydraulic circuit delivers hydraulic fluid at the control pressure to effect control of the torque transfer component during which a volume of hydraulic fluid from the high pressure hydraulic circuit is transferred to the low pressure hydraulic circuit; and wherein the exchange system resupplies the first tank with hydraulic fluid from the second tank substantially equivalent to the volume of hydraulic fluid transferred from the high pressure hydraulic circuit to the low pressure hydraulic circuit within the second hydraulic component.

15. The hydraulic system of claim 14, wherein the second hydraulic component includes an electric machine; and wherein the low pressure hydraulic circuit delivers hydraulic fluid to effect one or more of cooling and lubrication of the electric machine and the torque transfer component.

* * * * *